United States Patent [19]

Bauer

[11] Patent Number: 4,489,833

[45] Date of Patent: Dec. 25, 1984

[54] GUN CASE

[76] Inventor: James E. Bauer, 216 Birch Hill, Rochester, Mich. 48063

[21] Appl. No.: 400,297

[22] Filed: Jul. 21, 1982

[51] Int. Cl.[3] ..... B65D 81/02; B65D 85/30; B65D 85/00

[52] U.S. Cl. ..... 206/522; 206/317; 150/52 R

[58] Field of Search ..... 206/522, 317, 524.8; 150/52 R; 5/441, 442

[56] References Cited

U.S. PATENT DOCUMENTS

| | | | |
|---|---|---|---|
| 2,729,259 | 1/1956 | Abrams | 150/52 R |
| 2,872,960 | 2/1959 | Kolpin | 150/52 R |
| 3,319,685 | 5/1967 | Urban | 206/522 |
| 3,340,969 | 9/1967 | Rothberg | 5/441 |
| 3,865,166 | 2/1975 | Pedro | 150/52 R |

*Primary Examiner*—William T. Dixson, Jr.
*Attorney, Agent, or Firm*—Basile, Weintraub & Hanlon

[57] ABSTRACT

A case for transporting and storing guns. The case includes a flexible body having a sealed interior space. The body has a concave configuration defined by opposed sides, an integral bottom and an open top. An inflation member is mounted on the body and disposed in communication with the interior space within the flexible body for enabling the flexible body to be inflated and deflated. A fastener is provided for closing the open top end of the gun case to enclose a gun disposed within the sides and bottom of the body. In a preferred embodiment, an outer cover is provided which encircles the outer surface of the flexible body and includes a fastener mounted on opposite sides of an elongated aperture disposed adjacent the open top of the flexible body for releasably closing the aperture in the outer cover and, thereby, the open top of the flexible body. An inner cover is secured to the inner surface of the gun case to prevent puncture of the flexible body.

7 Claims, 2 Drawing Figures

GUN CASE

BACKGROUND OF THE INVENTION

1. Field Of The Invention

This invention relates, in general, to gun cases.

2. Description Of The Prior Art

Protective cases for guns have been devised to protect the guns from physical damage and the corrosive effects of atmospheric gasses and moisture when the guns are not in use. Such gun cases typically are formed with a hollow interior configured to receive the gun, such as a rifle, shotgun, etc., and include a cover for closing the case about the gun.

A common type of gun case is one having a rigid form which includes padding to protect the gun during storage and/or transportation. Other gun cases are made with a flexible material so as to be able to be rolled or folded up into a compact shape when not in use. It is also known to provide gun cases with straps or hangers for mounting such cases in a convenient location for storage and/or transportation.

However, such previously devised gun cases, while affording adequate protection for the gun, are still not without drawbacks. The rigid cases, while affording maximum protection for the gun, are bulky and difficult to transport and store. Such rigid cases, further, are configured to carry a particular type of gun and, thus, will not securely retain other guns having different dimensions in a fixed position within the case. The previously devised flexible gun cases are provided with limited amounts of padding so as to be able to be folded into a compact form when not in use. Such limited amounts of padding obviously afford a limited amount of protection for the gun when the gun is inserted into the case.

Thus, it would be desirable to provide a gun case which overcomes the problems of previously devised gun cases in affording maximum protection for the gun and, at the same time, is to be folded into a compact shape when the gun is removed for use. It would also be desirable to provide a gun case which can securely retain a wide variety of guns having differing dimensions. Finally, it would be desirable to provide a gun case which is lightweight and economical to manufacture.

SUMMARY OF THE INVENTION

There is disclosed herein a unique gun case for storing and transporting guns. The gun case includes a hollow, inflatable, flexible body having a sealed interior space. Means are provided on the flexible body communication with the interior space in the body for inflating the body. The body has a concave cross sectional configuration defined by opposed sides, an integral bottom and an open top.

Means are provided for releasably closing the open top of the flexible body. In a preferred embodiment, an outer cover encircles the body and includes an aperture which is disposed adjacent the open top of the flexible body. A releasable fastener is attached to the sides of the aperture in the outer cover and is operative to releasably close the aperture in the outer cover and, thereby, close the open top end of the flexible body. In a further embodiment, an inner cover member is disposed in registry with the interior sides of the inflatable body to prevent puncture of the inflatable body when the gun is inserted into the case.

The gun case of the present invention includes several unique features which cooperate to overcome the deficiencies encountered in previously devised gun cases. The gun case of the present invention is uniquely inflatable which enables it to be folded into a compact form when the gun is removed therefrom. More importantly, the amount of inflation of the flexible body may be varied, depending on the shape or form of the gun placed within the body, so as to exactly conform the body to the shape of the gun and thereby provide maximum protection for the gun. Finally, the gun case of the present invention is made from relatively few, inexpensive components which contribute to a light weight and an economical manufacturing cost.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
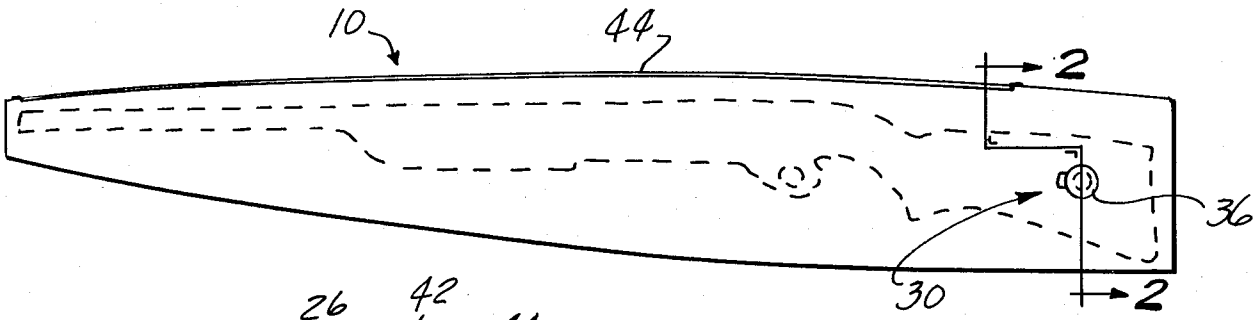
FIG. 1 is a side elevational view of the gun case of the present invention.

Throughout the following description and drawing, identical reference numbers are used to refer to the same component shown in multiple figures of the drawing.

Figure 2:
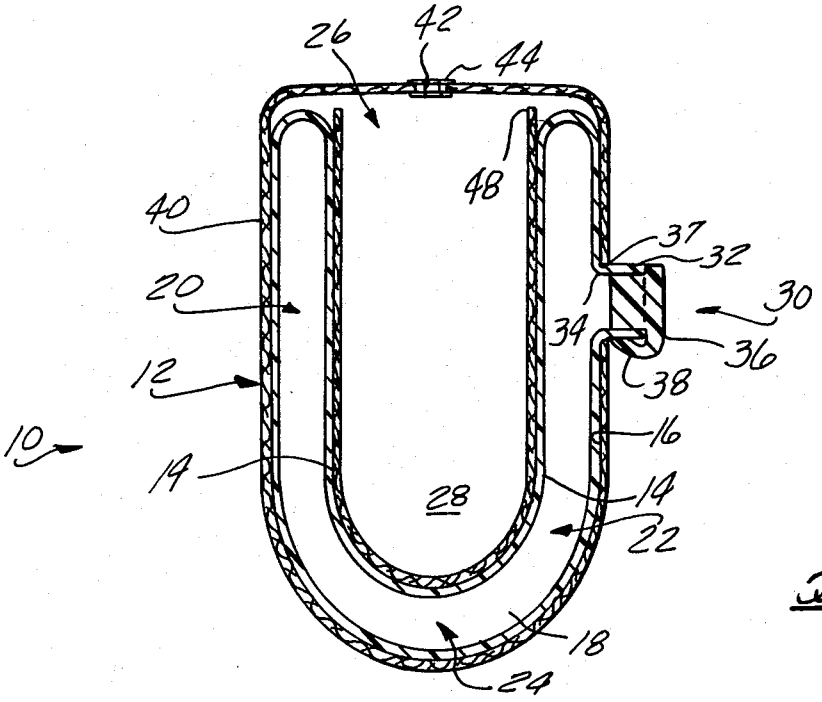
FIG. 2 is an enlarged, cross sectional view, generally taken along line 2—2 in FIG. 1.

Referring now to FIGS. 1 and 2 of the drawing, there is illustrated a gun case 10 which is suited for transporting and storing guns, such as rifles, shotguns, etc.

The gun case 10 includes a hollow body 12 which is formed of a flexible material, such as plastic, etc. The flexible body 12 is formed with inner and outer surfaces 14 and 16 which are integrally joined together to define a sealed, inflatable interior space 18.

The flexible body 12 has an elongated shape suited for receiving rifles, shotguns, etc. It will be understood, however, that other configurations may also be employed so as to conform the gun case 10 to smaller guns, such as hand guns, etc. The body 12 has a concave cross section defined by opposed sides 20 and 22, an integral bottom 24 and an open top 26. The sides 20 and 22 of the flexible body 12 are adapted to be spaced apart to define a hollow interior cavity 28 therebetween which is adapted to snugly receive a gun.

Means, denoted in general by reference number 30, are provided on the flexible body 12 in communication with the sealed interior space 18 for selectively inflating and deflating the interior space 18. Preferably, the inflating means 30 comprises an outwardly extending boss 32 which is integrally formed in one of the sides of the flexible body 12. The boss 32 includes a central bore 34 extending therethrough which is disposed in fluid flow communication with the interior space 18 of the flexible body 12. A removable cap 36 is provided for removably sealing the end of the bore 34 so as to seal the interior space 18 in the flexible body 12. The cap 36 may be integrally connected to the boss 32 by means of an integrally formed strap 38 which extends between a side edge of the cap 36 and a portion of the boss 32.

The gun case 12 of the present invention also includes means for closing the open top end 26 of the flexible body 12. Although the means for closing the open top end 26 of the flexible body 12 may include a fastening means mounted on the top ends of of the sides 20 and 22 of the flexible body 12 for releasably joining the top ends of the sides 20 and 22 together, it is preferred that the fastening means be applied on a separate outer cover member 40. In a preferred embodiment, the outer cover member 40 is formed of a soft, flexible material, such as cloth, and is configured in substantially the same shape as the flexible body 12. The outer cover 40 encircles the outer surface of the flexible body 12 and may be secured thereto by means of an adhesive. The outer cover 40 is formed with a first elongated aperture 42 which is disposed adjacent the open top end 26 of the flexible body 12. The aperture 42 extends along at least a portion of the length of the outer cover 40.

In a preferred embodiment, a releasable fastening means 44, such as a zipper, a Velcro-type fastener, etc., is applied to the side edges of the aperture 42 in the cover 40 and is adapted for releasably closing the side edges so as to close the open top end 26 of the flexible body 12 housed therein.

It is also preferred that an inner cover member 48 be provided within the interior of the flexible body 12 to protect the flexible body 12 from puncture on the sharp edges, projections, etc., on the gun which is disposed within the interior of the flexible body 12. Preferably, the inner cover 48 is formed of a soft cloth and is secured, such as by adhesive, to the inner surface 14 of the flexible body 12.

In use, the fastener 44 is opened and the flexible body 12 is deflated. A gun is then inserted into the interior of the flexible body 12 and the fastening means 44 closed to close off the interior of the flexible body 12. A fluid, such as air, is then injected through the boss 32 to inflate the flexible body 12 about the gun.

Thus, there has been disclosed a unique gun case which provides maximum protection for the gun during transportation and/or storage and, at the same time, may be folded into a compact form when the gun is removed from the case. Further, the amount of inflation may be varied so as to conform the gun case to the shape of a wide variety of guns. In addition, the components forming the gun case of the present invention are light in weight and economical to manufacture.

What is claimed is:

1. A gun case comprising:

a flexible body having opposed sides, an integral bottom, an open top and closed end, the body including a sealed, inflatable interior space extending along substantially the entire length of the opposed sides and bottom;

means, communicating with the interior space in the body, for inflating the body; and means for releasably closing the open top of the body.

2. The gun case of claim 1 further including: an outer cover encircling the flexible body.

3. The gun case of claim 2 wherein the means for releasably closing the open top of the body comprises:

an aperture formed in the outer cover adjacent the open top of the body; and releasable fastening means mounted on the outer cover for closing the aperture in the outer cover.

4. The gun case of claim 1 further including: an inner cover member disposed in registry with the interior surfaces of the sides and bottom of the body.

5. The gun case of claim 1 wherein the means for inflating the body comprises:

a boss having a hollow bore formed therein mounted on the body;

the bore communicating with the interior space within the body; and a removable cap for closing the bore in the boss and sealing the interior space within the body.

6. A gun case comprising:

a flexible body having opposed sides, an integral bottom, an open top and closed ends, the body including a sealed, inflatable interior space extending along subtantially along the entire length of the opposed sides and bottom;

means, communicating with the interior space in the body, for inflating the body;

an outer cover encircling the body, the outer cover having an elongated aperture formed therein disposed adjacent the open top of the body; and fastening means, mounted on the sides of the aperture in the outer cover, for releasably closing the aperture in the outer cover and the open top of the body.

7. The gun case of claim 6 further including: an inner cover member disposed in registry with the interior surfaces of the sides and bottom of the body.

* * * * *